US006908303B1

(12) United States Patent
Oda et al.

(10) Patent No.: US 6,908,303 B1
(45) Date of Patent: Jun. 21, 2005

(54) PREMIXED AIR-FUEL MIXTURE SUPPLY DEVICE

(75) Inventors: Takeo Oda, Kobe (JP); Hiroyuki Ninomiya, Akashi (JP); Masayoshi Kobayashi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 79 days.

(21) Appl. No.: 10/768,077

(22) Filed: Feb. 2, 2004

(30) Foreign Application Priority Data

Dec. 16, 2003 (JP) ..... 2003-418729

(51) Int. Cl.[7] ..... F23C 5/32
(52) U.S. Cl. ..... 431/173; 431/183; 60/733
(58) Field of Search ..... 431/7, 170, 183, 431/326, 353; 60/733, 737; 239/13, 427.3

(56) References Cited

U.S. PATENT DOCUMENTS 3,648,457 A * 3/1972 Bobo ..... 60/737
3,811,277 A * 5/1974 Markowski ..... 60/733
4,488,866 A * 12/1984 Schirmer et al. ..... 431/4
5,170,727 A * 12/1992 Nielsen ..... 110/346
5,183,401 A * 2/1993 Dalla Betta et al. ..... 431/7
6,174,160 B1 * 1/2001 Lee et al. ..... 431/11
6,394,791 B2 * 5/2002 Smith et al. ..... 431/170

FOREIGN PATENT DOCUMENTS

JP A 8-42851 2/1996
JP A 9-145057 6/1997
JP A 2002-206744 7/2002

* cited by examiner

*Primary Examiner*—Stephen Gravini
(74) *Attorney, Agent, or Firm*—Oliff & Berridge, PLC

(57) ABSTRACT

A premixed air-fuel mixture supply device is joined to a combustor liner included in a combustor for a gas turbine or an aircraft engine. The premixed air-fuel mixture supply device has a pilot fuel injection unit having an inner wall, and a prevaporizing, premixing main fuel injection unit having an outer wall surrounding the inner wall. A combustion air passage is defined by the inner and the outer wall. An intermediate wall is disposed in the combustion air passage so as to divide an upstream part of the combustion air passage into a secondary combustion air passage surrounding the inner wall, and an outer combustion air passage surrounding the intermediate wall. Fuel inject holes are formed in the intermediate wall to inject fuel radially outward into the outer combustion air passage. A swirling device is disposed in the secondary combustion air passage to swirl combustion air flowing through the secondary combustion air passage. An atomization lip is formed in a tail part of the intermediate wall.

10 Claims, 4 Drawing Sheets

PREMIXED AIR-FUEL MIXTURE SUPPLY DEVICE

BACKGROUND OF THE INVENTION

1. Field of the Invention

The present invention relates to a premixed air-fuel mixture supply device for supplying a premixed air-fuel mixture to a combustor for a gas turbine or an aircraft engine and, more particularly, to a premixed air-fuel mixture supply device capable of atomizing fuel satisfactorily while the associated combustor is in a low-load operation.

2. Description of the Related Art

A conventional combustor for a gas turbine or an aircraft engine has a combustor casing, and a cylindrical or annular combustor liner disposed in the combustor casing to define a combustion chamber. A fuel nozzle is connected to a head part of the combustor liner. The combustor casing and the combustor liner define an air passage through which air supplied by an air compressor flows into the combustion chamber.

When fuel is injected in air for diffusive combustion in the combustion chamber of this combustor of a gas turbine or an aircraft engine, high-temperature regions are formed locally in the combustion gas, and the high-temperature regions increases the concentration of $NO_x$ in the combustion gas.

Interest in environmental problems has progressively increased in recent years and restrictions on environmental condition have been intensified. The inlet temperature of recent gas turbines and aircraft engines, namely, the outlet temperature of the combustors of gas turbines and aircraft engines, has been raised to improve the thermal efficiency of the gas turbines and aircraft engines. However, the local high-temperature regions in the combustion gas produced by diffusive combustion increase and the concentration of $NO_x$ increases accordingly as the outlet temperature of the combustors of gas turbines and such increases. Therefore, measures for reducing $NO_x$ is very important.

A gas turbine combustor with a lean premixed, prevaporized combustion system (a prevaporized, premixed air-fuel mixture lean-burn type gas turbine combustor for a gas turbine) is proposed to reduce the concentration of $NO_x$ in the combustion gas. In this gas turbine combustor, part of fuel is supplied as pilot fuel into a pilot combustion region in a combustion chamber to produce high-temperature combustion gas by stable combustion, and a lean air-fuel mixture is burned in a main combustion region around and below the pilot combustion region for lean-burn combustion that scarcely produces $NO_x$. When a liquid fuel is used, the liquid fuel is vaporized beforehand to produce a prevaporized, premixed air-fuel mixture for lean burn. An air-blast atomization type premixed air-fuel mixture supply device injects main fuel substantially perpendicularly to the flowing direction of combustion air.

A conventional combustor for a gas turbine or an aircraft engine has a combustor casing and a cylindrical or annular combustor liner disposed in the combustor casing to define a combustion chamber. A fuel nozzle for injecting fuel into the combustion chamber is disposed at one end of the combustor liner. The premixed air-fuel mixture supply device according to the present invention has a main fuel injecting unit and a prevaporizing, premixing unit for vaporizing and mixing the fuel injected by the main fuel injecting unit in addition to the pilot fuel injecting unit.

Referring to FIG. 5 showing a conventional combustor, compressed air supplied by an air compressor, not shown, flows through a space between a combustor casing 1 and a combustor liner 2. When the combustor is a forward flow combustor, air flows in the direction of the blank arrow (→) and the right end, namely, the downstream end, of the combustor casing 1 is closed. When the combustor is a backward flow combustor, air flows in the direction of the arrow (←), and the left end, namely, the downstream end, of the combustor casing 1 is closed. Combustion air reached the combustor head flows into a pilot combustion air passage 3 and a main combustion air passage 4. Although the main combustion air passage 4 shown in FIG. 5 is divided into two air passages 4*a* and 4*b*, the main combustion air passage 4 does not necessarily need to be divided.

Referring to FIGS. 6 and 7 showing a prevaporizing, premixing unit, pilot fuel is injected out through fuel injection holes 5*a* formed in a pilot fuel injection nozzle 5 and arranged at angular intervals. Swirl devices 6*a* and 6*b* for swirling combustion air are disposed above the fuel injection holes 5*a*. Main fuel is injected out through main fuel injection holes 7 arranged at angular intervals. Swirl devices 8*a* and 8*b* for swirling combustion air are disposed above the main fuel injection holes 7. An atomization lip 9 extends downstream from the swirl devices 8*a* and 8*b* to atomize the main fuel. A prevaporizing, premixing chamber 10 is formed below the atomization lip 9. A premixed air-fuel mixture produced in the prevaporizing, premixing chamber 10 is supplied into a combustion chamber 15 below the prevaporizing, premixing unit. The premixed air-fuel mixture burns in the combustion chamber 15. In FIG. 7, the premixed air-fuel mixture supply device is provided with a single swirling device 8 instead of the two swirling devices 8*a* and 8*b* shown in FIG. 6, and is not provided with any member corresponding to the atomization lip 9

Related techniques are disclosed in JP-A 8-42851, JP-A 9-145057 AND JP-A 2002-206744.

A fuel injector included in combustor for a gas turbine or an aircraft engine operates according to load on the combustor that varies in a wide load range Therefore, in most cases where the combustor is in a low-load operation requiring fuel injection at a low rate, fuel injected by the fuel injector is unable to flow across air currents to or near to a wall surrounding the fuel injection valve and unable to vaporize satisfactorily. The fuel may be able to flow across air currents to or near to the wall when the number of the fuel-injecting hole is reduced or the diameter of the fuel injecting holes is reduced. If such measures are taken, the fuel needs to be fed at a very high fuel feed pressure when the combustor is in a high-load operation, and a large fuel feed system is necessary. The reduction of the number of fuel injecting holes deteriorates the mixing of fuel and combustion air; The fuel injecting holes may be closed by caulking when the diameter of the fuel injecting holes is reduced.

SUMMARY OF THE INVENTION

The present invention has been made to solve those problems in the prior art and it is therefore an object of the present invention to provide a premixed air-fuel mixture supply device for a gas turbine or an aircraft engine, capable of improving fuel atomization while the combustor of the gas turbine or the aircraft engine is in a low-load operation.

According to one aspect of the present invention, a premixed air-fuel mixture supply device combined with a premixed air-fuel mixture supply device combined with a combustor liner included in a combustor for a gas turbine or an aircraft engine comprises: a pilot fuel injection unit having an inner wall connected to a head part of the combustor liner; and a prevaporizing, premixing main fuel injection unit having an outer wall connected to the head part of the combustor liner and surrounding the inner wall; wherein the inner wall and the outer wall define a combustion air passage, an intermediate wall is disposed in the combustion air passage so as to divide an upstream part of the combustion air passage into an inner combustion air passage surrounding the inner wall, and an outer combustion air passage surrounding the intermediate wall, fuel injecting holes are formed in the intermediate wall to inject fuel radially outward so as to cross air currents flowing through the combustion air passage into the outer combustion air passage of the combustion air passage, and an atomization lip is formed in a tail part of the intermediate wall to promote atomization of fuel adhering to the tail part at a downstream edge of the intermediate wall.

According to another aspect of the present invention, a premixed air-fuel mixture supply device combined with a combustor liner included in a combustor for a gas turbine or an aircraft engine comprises: a pilot fuel injection unit having an inner wall connected to a head part of the combustor liner; and a prevaporizing, premixing main fuel injection unit having an outer wall connected to the head part of the combustor liner and surrounding the inner wall; wherein the inner wall and the outer wall define a combustion air passage, an intermediate wall is disposed in the combustion air passage so as to divide an upstream part of the combustion air passage into an inner combustion air passage surrounding the inner wall, and an outer combustion air passage surrounding the intermediate wall, fuel injecting holes are formed in the intermediate wall to inject fuel radially inward so as to cross air currents flowing through the combustion air passage into the inner combustion air passage of the combustion air passage, and an atomization lip is formed in a tail part of the intermediate wall to promote atomization of fuel adhering to the tail part at a downstream edge of the intermediate wall.

In the premixed air-fuel mixture supply device according to the present invention, the sectional area of the inner combustion air passage is 10% or below of the sectional area of the combustion air passage of the prevaporizing, premixing main fuel injection unit.

In the premixed air-fuel mixture supply device according to the present invention, the sectional area of the outer combustion air passage is 10% or below of the sectional area of the combustion air passage of the prevaporizing, premixing main fuel injection unit.

In the premixed air-fuel mixture supply device according to the present invention, a swirling device is disposed in the inner combustion air passage to swirl combustion air flowing through the inner combustion air passage in the same direction as combustion air flowing through the outer combustion air passage.

In the premixed air-fuel mixture supply device according to the present invention, a swirling device is disposed in the outer combustion air passage to swirl combustion air flowing through the outer combustion air passage in the same direction as combustion air flowing through the inner combustion air passage.

In the premixed air-fuel mixture supply device according to the present invention, a swirling device is disposed in the inner combustion air passage to swirl combustion air flowing through the inner combustion air passage in a direction opposite a direction in which combustion air flowing through the outer combustion air passage swirls.

In the premixed air-fuel mixture supply device according to the present invention, a swirling device is disposed in the outer combustion air passage to swirl combustion air flowing through the outer combustion air passage in a direction opposite a direction in which combustion air flowing through the inner combustion air passage swirls.

In the premixed air-fuel mixture supply device according to the present invention, the extremity of the atomization lip is formed in a sharp edge.

In the premixed air-fuel mixture supply device according to the present invention, the extremity of the atomization lip is cut perpendicularly or substantially perpendicularly to the flowing direction of combustion air.

The effect of injecting main fuel radially outward will be explained. Main fuel is injected perpendicularly or substantially perpendicularly to the air currents flowing through the combustion air passage from the intermediate wall into the outer combustion air passage. While the combustor associated with the premixed air-fuel mixture supply device is in a high-load operation, fuel is injected at a high injecting rate and a high injecting velocity through the fuel injecting holes. Consequently, the injected fuel impinges on the atomization lip, flows in a liquid film along the surface of the atomization lip, and is atomized satisfactorily at the edge of the atomization lip by air currents to produce a lean air-fuel mixture.

While the combustor is in a low-load operation, fuel is injected at a low injecting rate and a low injecting velocity through the fuel injecting holes. Consequently, most part of the injected fuel flows in a liquid film along the surface of the intermediate wall, and the outer surface of the atomization lip is atomized at the edge of the atomization lip by air currents flowing along the outer and the inner surface of the atomization lip, and the atomized fuel is vaporized and mixed with air to produce a lean premixed air-fuel mixture. Since the combustion air passage is divided into the outer and the inner air passages, and the atomization lip is extended in the combustion air passage, the liquid film can be atomized by air currents flowing along the outer and the inner surface of the atomization lip to provide the premixed air-fuel mixture supply device with an improved fuel-atomizing characteristic. The same effect can be exercised by injecting main fuel radially inward.

Fuel can be injected without increasing the fuel feed pressure when the combustor is in a high-load operation, and a large fuel feed system is not necessary. Since there is no need to reduce the number of the fuel injecting holes, fuel and combustion air can be satisfactorily mixed. And since there is no need to reduce the diameter of the fuel holes, the fuel holes will not be closed by caulking.

BRIEF DESCRIPTION OF THE DRAWINGS

The above and other objects, features and advantages of the present invention will become more apparent from the following description made in connection with the accompanying drawings, in which.

DESCRIPTION OF THE PREFERRED EMBODIMENTS

Figure 1:
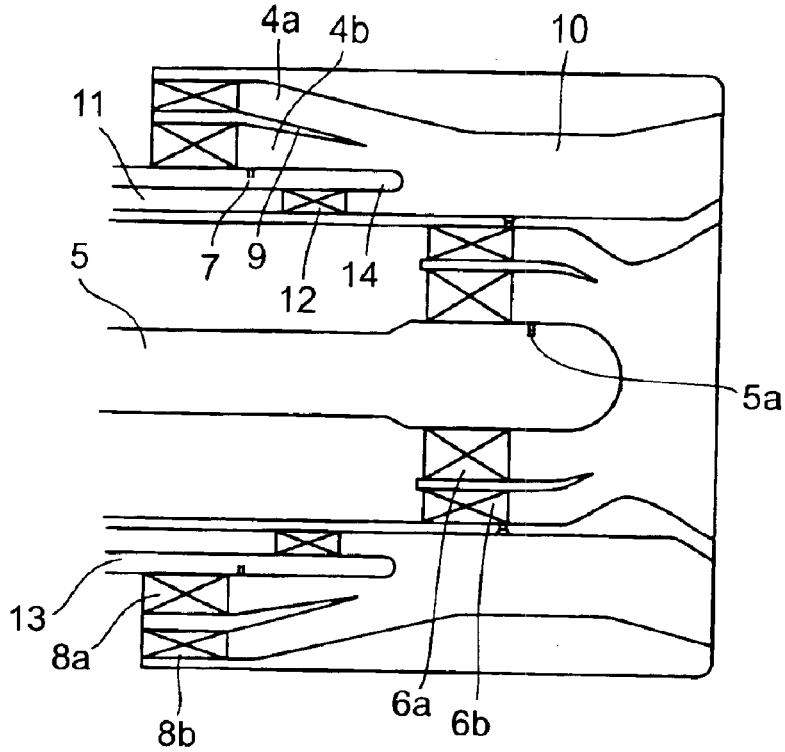
FIG. 1 is a schematic, longitudinal sectional view of a premixed air-fuel mixture supply device in a first embodiment according to the present invention that injects fuel radially outward.
Figure 5:
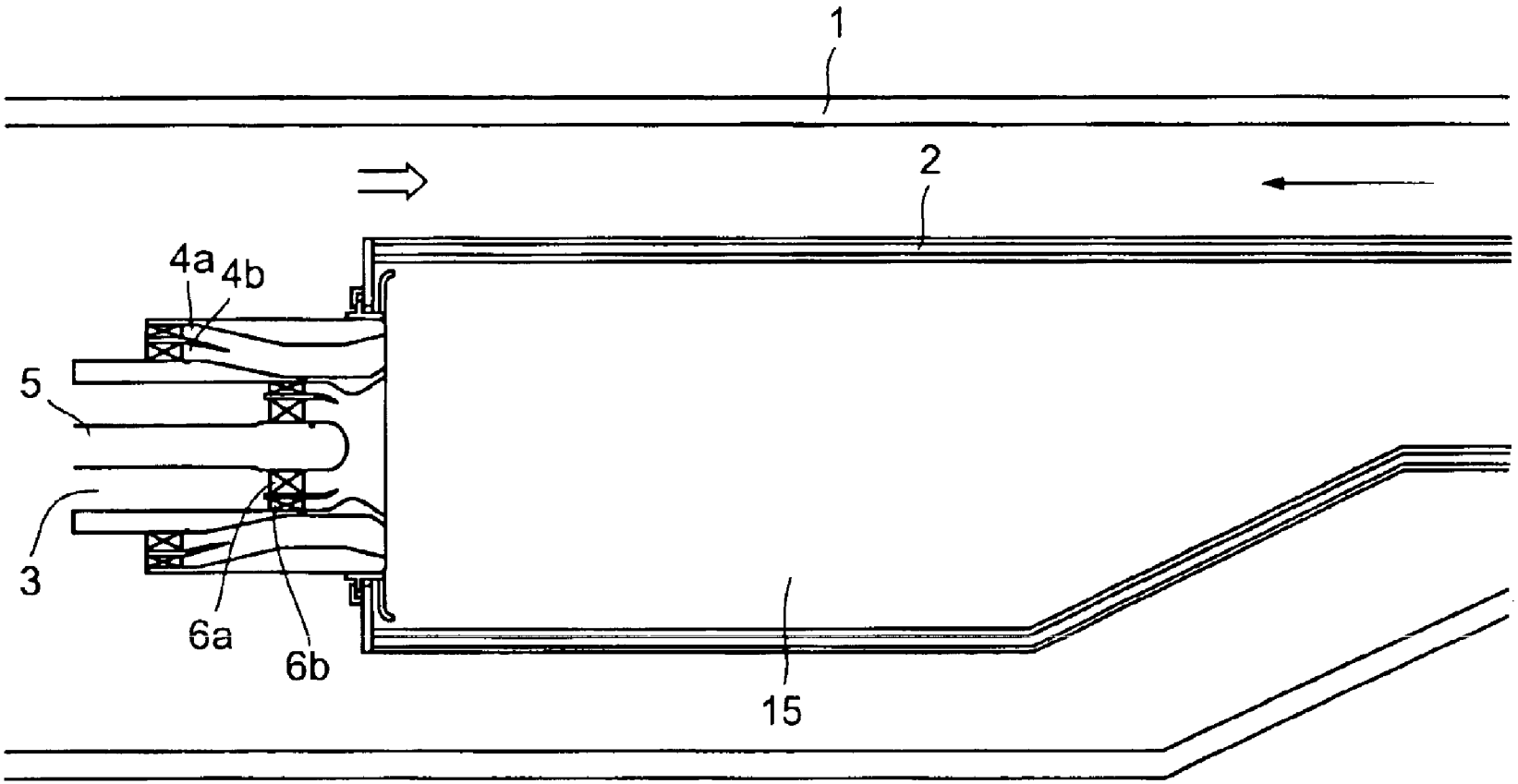
FIG. 5 is a schematic longitudinal sectional view of a conventional combustor.
Figure 6:
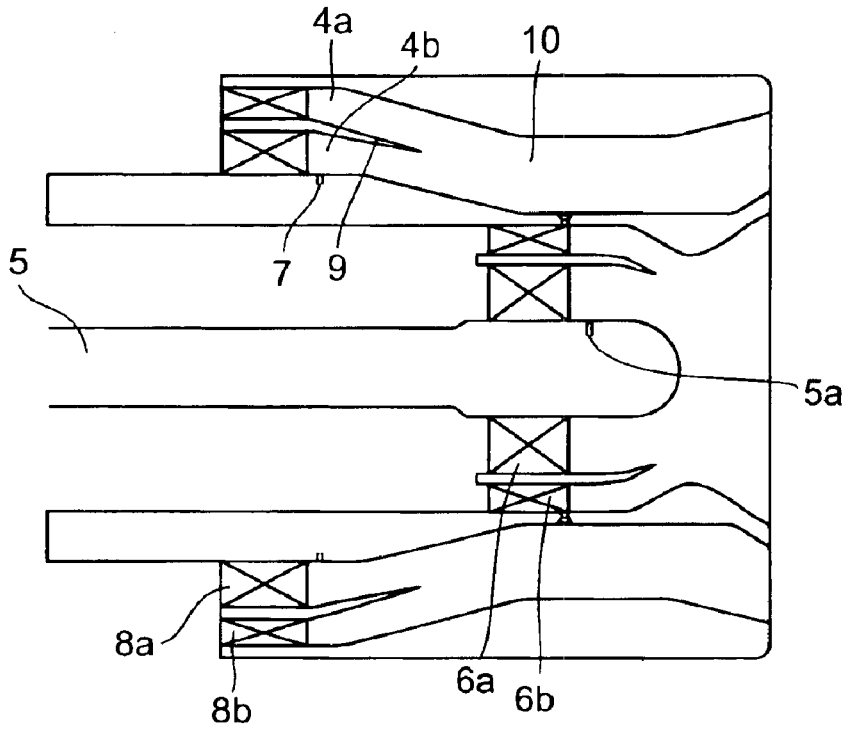
FIG. 6 is schematic longitudinal sectional view of a conventional premixing air-fuel mixture supply device.
Figure 7:
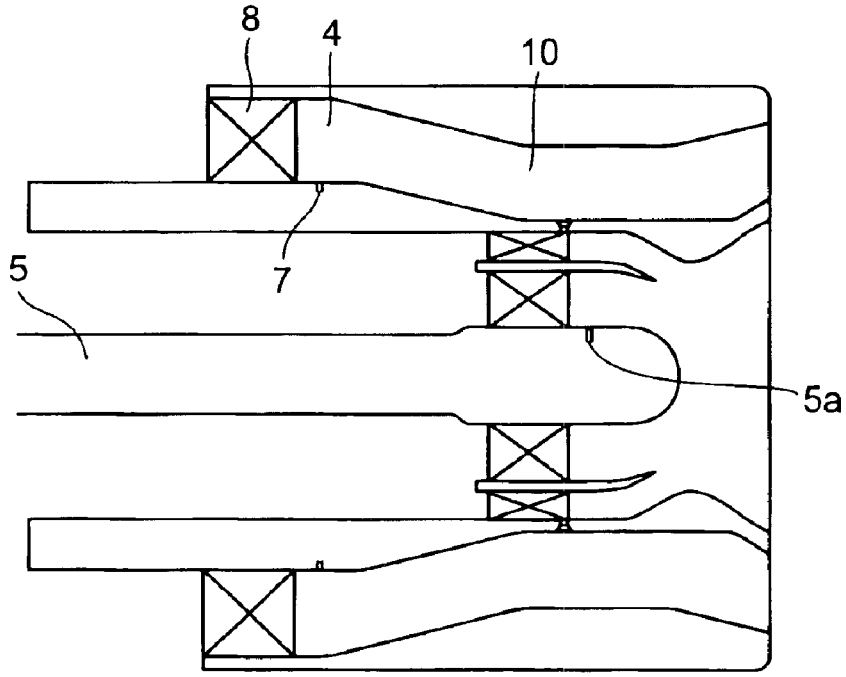
FIG. 7 is a schematic longitudinal sectional view of another conventional premixed air-fuel mixture supply device.

Referring to FIG. 1 showing a premixed air-fuel mixture supply device in a first embodiment according to the present invention that injects fuel radially outward, an inner wall is joined to the head of a combustor liner (combustor liner 2 shown in FIG. 5) and an outer wall is joined to the head of the combustor liner so as to surround the inner wall. A pilot fuel injection unit is formed inside the inner wall, and a main fuel injection unit is formed in a space defined by the inner and the outer wall. The main fuel injection unit has a prevaporizing, premixing chamber 10 and is provided with swirling devices and an atomization lip dividing an upstream part of the prevaporizing, premixing chamber 10 into an outer combustion air passage 4*a* and an inner combustion air passage 4*b*. An intermediate wall 13 is inserted in the inner combustion air passage 4*b* to define a secondary combustion air passage 11 around the inner wall. The intermediate wall 13 has a tail part shaped in an atomization lip 14, and is provided with main fuel injecting holes 7 arranged at angular intervals to inject fuel radially outward. Usually, the main fuel injecting holes 7 are formed so as to inject fuel perpendicularly to the flowing direction of combustion air. In some cases, the main fuel injecting holes 7 are formed so as to inject fuel in a direction opposite the flowing direction of combustion air. A swirling device 12 is disposed in the secondary combustion air passage 11. A swirling direction in which the swirling device 12 swirls combustion air is determined as the occasion demands. In some cases, the swirling device does not swirl combustion air.

Figure 2:
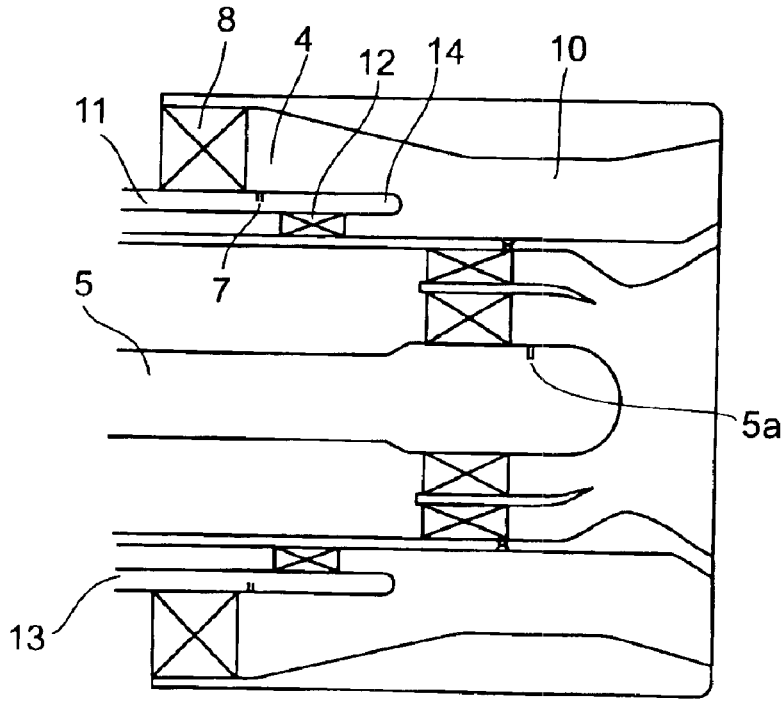
FIG. 2 is a schematic, longitudinal sectional view of a premixed air-fuel mixture supply device in a second embodiment according to the present invention that injects fuel radially outward.

FIG. 2 shows a premixed air-fuel mixture supply device in a second embodiment according to the present invention that injects fuel radially outward. The premixed air-fuel mixture supply device in the second embodiment is substantially identical in construction and function with the premixed air-fuel mixture supply device in the first embodiment, except that the premixed air-fuel mixture supply device in the second embodiment has a prevaporizing, premixing chamber 10 not divided into two combustion air passages and provided with a single swirling device 8.

Figure 3:
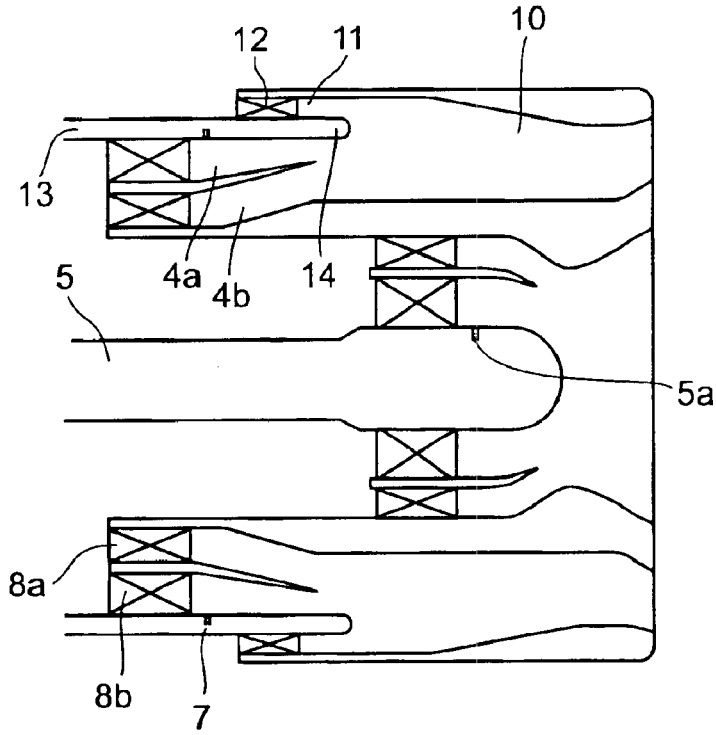
FIG. 3 is a schematic longitudinal sectional view of a premixed air-fuel mixture supply device in a third embodiment according to the present invention that injects fuel radially inward.

FIG. 3 shows a premixed air-fuel mixture supply device in a third embodiment according to the present invention that injects fuel radially inward. Referring to FIG. 3, an inner wall is joined to the head of a combustor liner (combustor liner 2 shown in FIG. 5) and an outer wall is joined to the head of the combustor liner so as to surround the inner wall. A pilot fuel injection unit is formed inside the inner wall, and a main fuel injection unit is formed in a space defined by the inner and the outer wall. The main fuel injection unit has a prevaporizing, premixing chamber 10 and is provided with swirling devices and an atomization lip dividing an upstream part of the prevaporizing, premixing chamber 10 into an outer combustion air passage 4*a* and an inner combustion air passage 4*b*. An intermediate wall 13 is inserted in the outer combustion air passage 4*a* to define a secondary combustion air passage 11 around the inner wall. The intermediate wall: 13 has a tail part shaped in an atomization lip 14, and is provided with main fuel injecting holes 7 arranged at angular intervals to inject fuel radially outward. Usually, the main fuel injecting holes 7 are formed so as to inject fuel perpendicularly to the flowing direction of combustion air. In some cases, the main fuel injecting holes 7 are formed so as to inject fuel in a direction opposite the flowing direction of combustion air. A swirling device 12 is disposed in the secondary combustion air passage 11. A swirling direction in which the swirling device 12 swirls combustion air is determined as the occasion demands. In some cases, the swirling device does not swirl combustion air.

Figure 4:
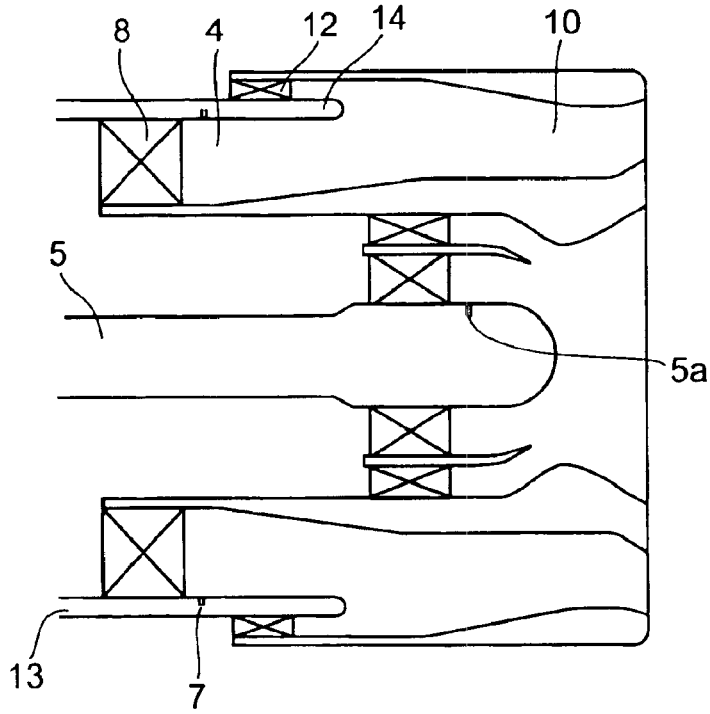
FIG. 4 is a schematic longitudinal sectional view of a premixed air-fuel mixture supply device in a fourth embodiment according to the present invention that injects fuel radially inward

FIG. 4 shows a premixed air-fuel mixture supply device in a fourth embodiment according to the present invention that injects fuel radially inward. The premixed air-fuel mixture supply device in the fourth embodiment is substantially identical in construction and function with the premixed air-fuel mixture supply device in the third embodiment, except that the premixed air-fuel mixture supply device in the fourth embodiment has a prevaporizing, premixing chamber 10 not divided into two combustion air passages and provided with a single swirling device 8. Referring to FIG. 4, an inner wall is joined to the head of a combustor liner (combustor liner 2 shown in FIG. 5) and an outer wall is joined to the head of the combustor liner so as to surround the inner wall. A main fuel injection unit is formed in a space defined by the inner and the outer wall. The main fuel injection unit has a prevaporizing, premixing chamber 10 having a combustion air passage 4, and is provided with a swirling device 8. An intermediate wall 13 is inserted in the combustion air passage 4 to define a secondary combustion air passage 11 around the combustion air passage 4. The intermediate wall 13 has a tail part shaped in an atomization lip 14, and is provided with main fuel injecting holes 7 arranged at angular intervals to inject fuel radially inward. Usually, the main fuel injecting holes 7 are formed so as to inject fuel perpendicularly to the flowing direction of combustion air. In some cases, the main fuel injecting holes 7 are formed so as to inject fuel in a direction opposite the flowing direction of combustion air. A swirling device 12 is disposed in the secondary combustion air passage 11. A swirling direction in which the swirling device 12 swirls combustion air is determined as the occasion demands. In some cases, the swirling device does not swirl combustion air.

The foregoing premixed air-fuel mixture supply devices embodying the present invention have an improved fuel atomizing effect.

The effect of swirling directions in which the swirling devices 8 and 12 swirl combustion air will be described with reference to FIG. 2. When the swirling directions in which the swirling devices 8 and 12 swirl combustion air are the same, the mixing of air currents passed the swirling devices 8 and 12 at the edge of the atomization lip 14 becomes worse to some extent, and the diffusion of fuel injected through the main fuel injecting holes 7 is suppressed adversely affecting the mixing of fuel and combustion air. Consequently, an air-fuel mixture having portions respectively having different fuel concentrations is produced and flame stability is improved particularly while the associated combustor is in a low-load operation. At the same time, the intensity of swirling of combustion air at the exit of the prevaporizing, premixing chamber 10 increases, further improving flame stability. The swirling directions in which the swirling devices 8 and 12 swirl combustion air are thus determined when flame stability while the combustor is in a low-load operation is important. In this case, the production of $NO_x$ increases slightly.

When the swirling directions in which the swirling devices 8 and 12 swirl combustion air are opposite to each other, the mixing of air currents passed the swirling devices 8 and 12 at the edge of the atomization lip 14 is promoted, and the injection of fuel injected through the main fuel injecting holes 7 is improved favorably affecting the mixing of fuel and combustion air. Consequently, flame stability deteriorates and the production of $NO_x$ decreases.

Effect of the respective sectional areas of the combustion air passage 4 and the secondary combustion air passage 11 will be described with reference to FIG. 2. Suppose that the respective sectional areas of the combustion air passage 4 and the secondary combustion air passage 11 are 4*s* and 11*s*. The air-fuel mixing characteristic of the premixed air-fuel mixture supply device deteriorates with the increase of the sectional area ratio: 11*s*/(4*s*+11*s*) while the combustor in a high-load operation. Desirably, the sectional area ratio is 10% or below. The deterioration of the air-fuel mixing characteristic of the premixed air-fuel mixture supply device can be avoided even if the sectional ratio is greater than 10% by determining the fuel injecting direction and the diameter of the fuel injecting holes 7 such that part of fuel is atomized satisfactorily by the atomization lip 14 while the combustor is in a high-load operation.

Although the edges of the tail parts of the atomization lips 14 shown in FIGS. 1 to 4 are rounded, it is also effective in satisfactorily atomizing the fuel to sharpen the edge of the tail part, or to cut the edge of the tail part perpendicularly to the flowing direction of combustion air. When the edge of the tail part of the atomization lip 14 is sharpened, a fuel film can be torn and atomized in minute fuel droplets. When the edge of the tail part is cut perpendicularly to the flowing direction of combustion air, the sectional area of the combustion air passage increases sharply at the edge of the atomization lip. Such a sudden increase in the sectional area of the combustion air passage disturbs the air currents flowing along the surfaces of the atomization lip 14 around the edge of the atomization lip 14 or produces small eddies, promoting the atomization of the fuel.

Although the swirling devices shown in FIGS. 1 to 4 are supposed to be axial swirling devices, radial swirling devices may be used instead of the axial swirling devices. Although the foregoing premixed air-fuel mixture supply devices are supposed to have cylindrical shapes, the same may be formed in annular shapes.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A premixed air-fuel mixture supply device combined with a combustor liner included in a combustor for a gas turbine or an aircraft engine, said premixed air-fuel mixture supply device comprising:

a pilot fuel injection unit having an inner wall connected to a head part of the combustor liner; and a prevaporizing, premixing main fuel injection unit having an outer wall connected to the head part of the combustor liner and surrounding the inner wall;

wherein the inner wall and the outer wall define a combustion air passage, an intermediate wall is disposed in the combustion air passage so as to divide an upstream part of the combustion air passage into an inner combustion air passage surrounding the inner wall, and an outer combustion air passage surrounding the intermediate wall, fuel injecting holes are formed in the intermediate wall to inject fuel radially outward so as to cross air currents flowing through the combustion air passage into the outer combustion air passage of the combustion air passage, and an atomization lip is formed in a tail part of the intermediate wall to promoting the atomization of fuel adhering to the tail part at a downstream edge of the intermediate wall.

2. A premixed air-fuel mixture supply device combined with a combustor liner included in a combustor for a gas turbine or an aircraft engine, said premixed air-fuel mixture supply device comprising:

a pilot fuel injection unit having an inner wall connected to a head part of the combustor liner; and a prevaporizing, premixing main fuel injection unit having an outer wall connected to the head part of the combustor liner and surrounding the inner wall;

wherein the inner wall and the outer wall define a combustion air passage, an intermediate wall is disposed in the combustion air passage so as to divide an upstream part of the combustion air passage into an inner combustion air passage surrounding the inner wall, and an outer combustion air passage surrounding the intermediate wall, fuel injecting holes are formed in the intermediate wall to inject fuel radially inward so as to cross air currents flowing through the combustion air passage into the inner combustion air passage of the combustion air passage, and an atomization lip is formed in a tail part of the intermediate wall to promote the atomization of fuel adhering to the tail part at a downstream edge of the intermediate wall.

3. The premixed air-fuel mixture supply device according to claim 1, wherein a sectional area of the inner combustion air passage is 10% or below of a sectional area of the combustion air passage of the prevaporizing, premixing main fuel injection unit.

4. The premixed air-fuel mixture supply device according to claim 2, wherein a sectional area of the outer combustion air passage is 10% or below of a sectional area of the combustion air passage of the prevaporizing, premixing main fuel injection unit.

5. The premixed air-fuel mixture supply device according to claim 1, wherein, a swirling device is disposed in the inner combustion air passage to swirl combustion air flowing through the inner combustion air passage in the same direction as combustion air flowing through the outer combustion air passage.

6. The premixed air-fuel mixture supply device according to claim 2, wherein a swirling device is disposed in the outer combustion air passage to swirl combustion air flowing through the outer combustion air passage in the same direction as combustion air flowing through the inner combustion air passage.

7. The premixed air-fuel mixture supply device according to claim 1, wherein a swirling device is disposed in the inner combustion air passage to swirl combustion air flowing through the inner combustion air passage in a direction opposite a direction in which combustion air flowing through the outer combustion air passage swirls.

8. The premixed air-fuel mixture supply device according to claim 2, wherein a swirling device is disposed in the outer combustion air passage to swirl combustion air flowing through the outer combustion air passage in a direction opposite a direction in which combustion air flowing through the inner combustion air passage swirls.

9. The premixed air-fuel mixture supply device according to claim 1, wherein an extremity of the atomization lip is formed in a sharp edge.

10. The premixed air-fuel mixture supply device according to claim 1, wherein an extremity of the atomization lip is cut perpendicularly or substantially perpendicularly to a flowing direction of combustion air.

* * * * *